United States Patent [19]

Stranger-Johannessen

[11] 3,938,206

[45] Feb. 17, 1976

[54] METHOD FOR CONTINUOUS DISPLACEMENT WASHING OF LIQUID-CONTAINING PULP MATERIALS

[76] Inventor: Per Stranger-Johannessen, Minister Ditleffs vei 17a, Oslo 8, Norway

[22] Filed: Jan. 8, 1974

[21] Appl. No.: 431,734

[30] Foreign Application Priority Data

Jan. 10, 1973 Norway ..... 99/73

[52] U.S. Cl. ..... 8/156; 68/158; 68/181 R; 68/184

[51] Int. Cl.[2] ..... D06B 3/02; D21C 9/02

[58] Field of Search ..... 8/156; 68/148, 158, 44, 68/181 R, 184, 45; 162/60, 202, 211, 289, 297

[56] References Cited

UNITED STATES PATENTS

| | | | |
|---|---|---|---|
| 3,454,970 | 7/1969 | Sutherland | 8/156 |
| 3,832,283 | 8/1974 | Bartley et al. | 162/211 |

*Primary Examiner*—Harvey C. Hornsby
*Assistant Examiner*—Philip R. Coe
*Attorney, Agent, or Firm*—Haseltine, Lake & Waters

[57] ABSTRACT

Liquid-containing pulp material, especially sulphate pulp containing black liquor, is deposited as a mat on a moving filter and subjected to displacement washing with a liquid such as clean water supplied to one side of the pulp mat and displacing the black liquor, which emerges in substantially undiluted form from the opposite side of the mat. The filter is a screen moving over a supporting floor, said floor and screen together forming a "resistance floor" providing a substantial flow resistance to the liquid. A layer of displacement or washing liquid (e.g., water) is maintained over the pulp mat covering the surface thereof. This layer may have a depth or height of e.g. 10 to 100 cm, thus protecting the surface of the mat against the effect of supply means for displacement liquid and providing a pressure on the upper side of the pulp mat assisting in overcoming the flow resistance of the pulp and the floor.

8 Claims, 1 Drawing Figure

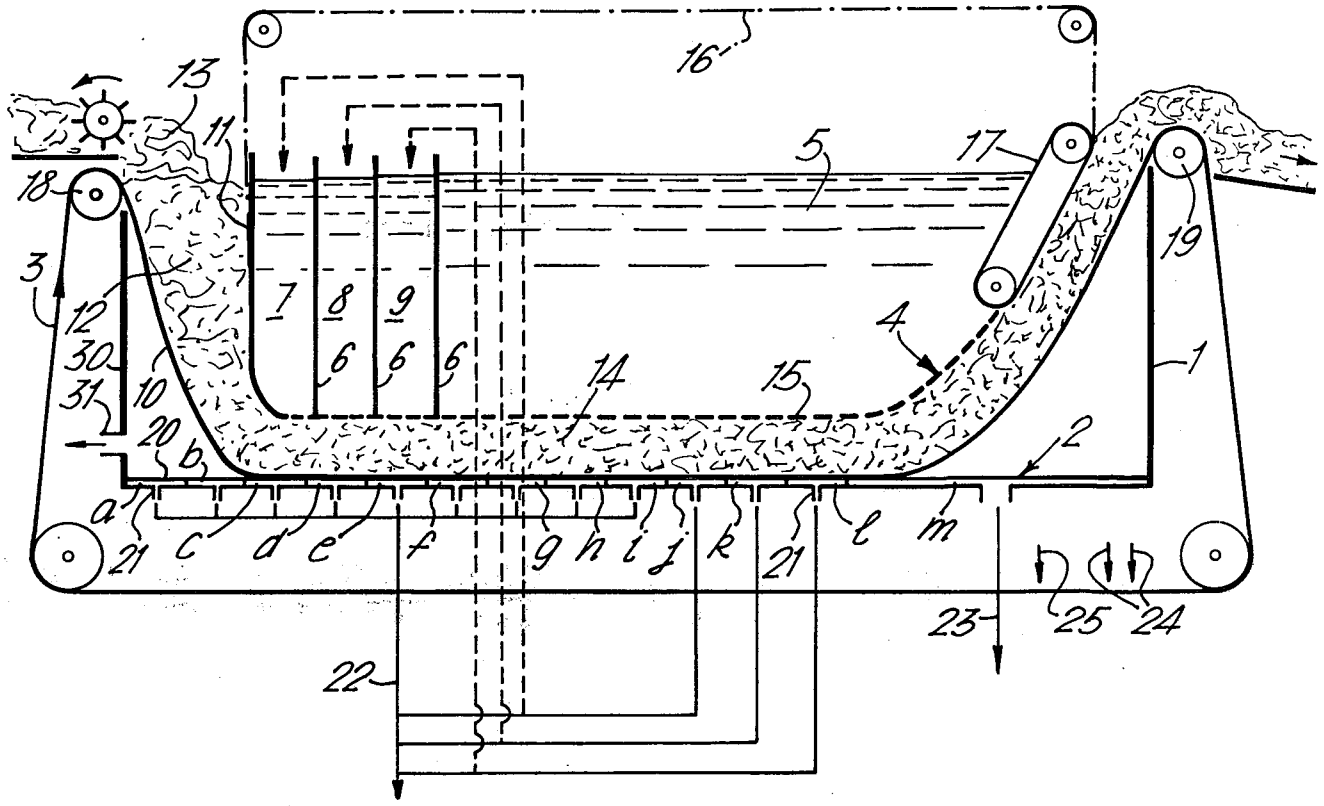
1
2
3
4
5
6
7
8
9
10
11
12
13
14
15
16
17
18
19
20
21
22
23
24
25
30
31
a
b
c
d
e
f
g
h
i
j
k
l
m

METHOD FOR CONTINUOUS DISPLACEMENT WASHING OF LIQUID-CONTAINING PULP MATERIALS

BACKGROUND OF THE INVENTION

The present invention relates to a method for continuous displacement washing of liquid-containing pulp materials, wherein the pulp is deposited on a moving filter, displacement liquid is supplied to the pulp and a difference in pressure is maintained across the pulp to replace the liquid therein with displacement liquid and recover substantially undiluted liquid from the pulp.

The method according to the invention may be used on various pulps such as fibrous pulp in the wood-pulp industry, pulps of granular particles such as mash in breweries, pulps of comminuted crushed sugar cane, etc. The invention is not dependent upon the formation of a pulp cake such as in the washing of pulps in the wood-pulp industry, but the pulp must be deposited in such a way that a reasonably uniform pulp distribution is obtained. The invention is especially developed for recovering liquor from sulphate pulp and will be described below on the basis of this use.

For recovering black liquor from sulphate pulp there are used batteries of diffusers, continuous diffusers in which the displacement liquid must traverse a distance of approximately 30 cm through the pulp, and continuous filters on which the pulp is deposited in mats of 2 cm or more. Washing liquid is supplied to the surface of the pulp and shall penetrate the pulp at a rate that should be as uniform as possible over the entire surface of the pulp in order that the liquid initially emerging from the opposite side of the pulp through the filter shall be as undiluted as possible. However, it is difficult to deposit the pulp on the filter in such a manner that the pulp will not afford a locally reduced flow resistance. In places having a reduced flow resistance the washing liquid will flow much faster through the pulp than in the remaining places, resulting in an undesired dilution of the black liquor recovered from the pulp. No layer of liquid is maintained over the pulp, probably because the washing liquid is not to flow laterally to places where the flow resistance is least, but is to act through the entire pulp. Instead, nozzles spaced as uniformly as possible over the surface of the pulp are used, which nozzles sprinkle water onto the surface. However, such a sprinkling through nozzles can never provide an entirely uniform water supply. The supply will always be greater locally. Also this fact leads to a dilution of the displaced liquid.

SUMMARY OF THE INVENTION

The object of the invention is to provide a method for continuous displacement washing of pulp such as sulphate pulp, in which the above disadvantages are substantially reduced, thereby permitting a higher recovery rate and/or lower installation and operational costs than in previously used methods and apparatus for continuous displacement washing.

The method according to the invention is characterized by moving a filter web or screen over a supporting floor, said floor and screen together providing a substantial flow resistance compared with the average flow resistance through the pulp mat, and maintaining a layer of displacement liquid over the pulp mat covering the surface thereof. The term "resistance floor" as used in the claims and the specification is intended to mean a structure which may be either the filter web, the support floor or a combination of both, in which resistance floor a back pressure is developed which provides the desired increased resistance to the flow of displaced liquids through the pulp mat and yet permits the desired displacement rate.

Whereas in previous diffusers and displacement filters screens or filter webs not providing any substantial flow resistance are used, the present invention prescribes the use of a filter which may be termed a resistance floor. The desired resistance may be obtained by means of a supporting floor over which the filter web or screen is passed. Such an additional resistance will prevent any "short-circuiting" through cracks in the pulp providing a resistance through the pulp of approximately zero. Thus, if the resistance floor provides a resistance of for instance 0.5 times the average resistance through the pulp, the influence of such a crack will immediately be reduced and correspond to the presence of a local reduction in the resistance of 67%. The obtained resistance essentially reduces the passage of liquid through the crack. If the resistance floor provides a resistance of for instance 4 times the average resistance through the pulp, which is no way the upper limit of the resistance which may be used in the resistance floor, a crack will correspond to a local reduction in the resistance of 17%. Smaller variations in the resistance than corresponding to a complete short-circuiting through the pulp will be correspondingly reduced by the resistance floor. At the same time the displacement liquid (washing liquid) is according to the invention supplied uniformly and gently, since the liquid layer will permit equalizing of the liquid supply and protect the pulp against direct influence from the supply nozzles. Preferably, the liquid layer is sufficiently deep to place the upper side of the pulp under pressure. The liquid layer may for instance be 10 to 100 cm deep. The higher the liquid layer, the coarser, simpler and cheaper may be the liquid supply means without adverse effects on the pulp. Thus, it may become completely unnecessary to use nozzles.

In order that the hydrostatic pressure at the bottom of the liquid layer shall not induce an undesired liquid flow in the horizontal direction through the pulp, the hydrostatic pressure in the pulp, especially upstream of the pulp mat, at the level of the upper side of the pulp mat may equal the horizontal pressure at the bottom of the liquid layer. Simultaneously, this hydrostatic pressure provides an over-pressure in the system which is desired when a relatively high resistance is maintained through the filter by using a resistance floor. This is because it is not always practical to provide the desired difference in pressure across the filter merely by means of an underpressure below the resistance floor, since this may entail i.e. unnecessary costs or disturbing gas development phenomena.

However, under certain conditions such an overpressure is unnecessary, and the liquid layer may then have a thickness of merely some millimeter, which admittedly requires nozzles to obtain a uniform water supply.

In any case, the total liquid column in the pulp mat and the superjacent liquid layer should exert an hydrostatic pressure which together with a suitable underpressure below the resistance floor is appropriate for surmounting the flow resistance at the desired displacement rate.

The desired hydrostatic pressure in the pulp and the liquid layer may preferably be obtained by providing a generally horizontal liquid-penetrable partition floor between the liquid layer and the pulp mat, said partition floor forming the bottom of a compartment for displacement liquid and being positioned within a vat, and forming the pulp on a screen while passing said screen into the vat.

In the method according to the invention a better separation of liquid phases having different levels of concentration is obtained due to a relatively more uniform flow resistance and a more gentle supply of displacement liquid. Thus, over a large portion of the resistance floor there is obtained substantially undiluted (100%) cooking liquor. Thereupon, the liquid emerging through the filter will be more and more diluted. Whereas the liquid may be passed direct to the sewer when the concentration goes below a certain level, the liquid emerging from a transitional length of the screen where dilution of the pulp begins may be recirculated for use as displacement liquid for initial displacement in the first part of the filter.

The apparatus used to perform the method of the invention is characterized by a moving screen supported by a floor, said screen and floor together providing a substantial flow resistance compared with the normal flow resistance across a pulp mat formed on the screen, and means for maintaining a layer of displacement liquid over the pulp mat covering the surface thereof.

The means for maintaining a layer of liquid over the pulp mat consists of a compartment having a generally horizontal liquid-penetrable partition floor. The partition floor is preferably positioned within a vat, and an endless screen may be arranged to be passed down into the vat from a position outside the vat, below the partition floor, up from the vat and back to the starting point. An inlet chest for pulp may be formed between the portion of the screen moving down into the vat and a wall of the compartment for displacement liquid. The filling level in the inlet chest may be adjusted to maintain the desired hydrostatic pressure in the pulp at the level of the partition floor.

I.e., due to variations in the properties of the pulp the displacement rate may vary, which would entail that the position of the abovementioned transitional length where dilution of the displaced liquid begins, may vary. However, the speed of the screen may advantageously be adjustable in response to the concentration at a certain position of the screen in order to maintain as constant as possible the concentration at this position and consequently the position of the transitional length. Alternatively, the transitional length may be divided into sections and the liquid from these sections conducted in such a manner that the concentration of the liquid determines where it is to be directed.

Additional features of the invention and especially the apparatus for carrying out the method will appear in more detail from the following description, reference being had to the drawing, which highly diagrammatically illustrates the principles of the apparatus according to the invention.

DESCRIPTION OF THE PREFERRED EMBODIMENT

In the drawing there is shown a vat 1, the floor 2 of which is designed as a resistance floor, for instance having a structure which will be discussed in more detail later. A continuous screen 3 of comparatively close weave is adapted to move down into the vat 1 over the resistance floor 2 and up from the vat at the opposite end. Within the vat 1 there is provided a compartment 4 for displacement liquid 5. The first part of the compartment 4 may be divided into several sections 7, 8 and 9 by means of partitions 6 extending transversely of the direction of movement of the screen. Between the portion 10 of the screen moving down into the vat 1 at one end thereof and a wall 11 of the compartment 4 for displacement liquid 5 there is formed an inlet chest 12 to which pulp 13 is supplied from a pulp buffer which is not shown. The pulp, which especially may be sulphate pulp containing black liquor, is formed in the inlet chest to a pulp mat 14 on the portion of the screen 3 moving over the resistance floor 2. The pulp mat 14 will fill the space between the screen 3 and the floor 15 of the compartment 4 for displacement liquid. This floor 15 is liquid-penetrable and may for instance be perforated. It should consist of a material affording a relatively low friction against the pulp 14 so that the movement thereof together with the screen 3 is not obstructed. Alternatively, an endless, liquid-penetrable (for instance perforated) belt 16 moving with the pulp as indicated by a dash-and-dot line in the drawing may slide below the partition floor. Such a belt may also replace the partition floor, suitable guide walls being then provided within the vat 1. If no moving belt 16 is provided, a short conveyor belt 17 may be provided at the outlet end to press clean pulp against the screen 3 and convey it up from the vat 1.

In order that the screen 3 may be guided in the desired direction within the vat 1 it may preferably be stiffened in the transverse direction while being readily pliable in the longitudinal direction. Thereby, it becomes possible to manage with a guiding of the screen along the side walls of the vat. An undesired tensioning of the screen 3 within the vat 1 may also be avoided by operating and controlling relatively to each other both a guide roller 18 and a guide roller 19 for the screen 3 at the inlet to the vat 1 and the outlet therefrom, respectively.

The resistance floor 2 may be subjected to an under-pressure at the under-side, which under-pressure together with the hydrostatic pressure at the screen 3 provides the required difference in pressure for overcoming the flow resistance through the pulp mat 14 and the resistance floor 2. In the embodiment illustrated the resistance floor 2 is divided longitudinally into sections *a* to *m*, which in turn may be divided transversely into sections. Each section consist of an upper sieve portion 20 having a relatively small resistance and one or more subjacent nozzles 21 determining the flow resistance through the section. The volume of each section between the sieve portion 20 and the nozzle 21 should preferably be as small as possible, especially in a transitional length formed by the sections *j*, *k* and *l* and discussed in more detail later, such a small dead volume reducing the slowness of the system when continuously controlled in order to obtain a stable operation as far as possible. Other designs of the resistance floor is possible. For instance, the desired resistance may be obtained merely by a screen of close weave having a desired uniformly distributed resistance, and in that case an extensive division of the resistance floor into sections as illustrated in the drawing is not required.

The sections *a* and *b* form a preconditioning zone for adjustment of the concentration. A relatively large outlet 31 in the end wall 30 at the inlet end may also serve for preconditioning. The sections *a* to *i* are shown in the drawing to be connected to a common conduit 22 for concentrated cooking liquor which is discharged for further working. Also the sections *j*, *k* and *l* have been shown as connected to the conduit 22 for concentrate, but it has also been indicated in dotted lines that liquid emerging from these sections may be recirculated to the sections 7, 8 and 9 in order to be reused as displacement liquid for initial displacement in the first part of the filter. The operation of the apparatus according to the invention may be adjusted for instance by controlling the speed of the screen 3 in such a manner that the concentration of the liquid emerging from the resistance floor sections *a* to *i* is about 100%, whereas liquid having a decreasing concentration emerges from the sections *j*, *k* and *l*, for instance 99–95% from section *j*, 95–90% from section *k* and 90–85% from section 1. Section m defines an after-washing zone in which the concentration may be so low that the liquid may be passed direct to the sewer through a conduit 23. Alternatively, liquid from these sections may be used for other purposes in the factory. The apparatus may also be operated with a constant speed of the screen, and the discharge of liquid from the sections *j* to *m* may be controlled in response to the concentration of the liquid. In some systems it is also conceivable that it is desired to take care of the liquid even down to a concentration of for instance 30%. It will be understood that this is fully possible by a suitable division of the resistance floor and control of the liquid flows. Thus, the invention is not restricted to the recovery of undiluted liquid.

The endless running screen 3 may conveniently be reconditioned outside the vat 1 on its way back to the inlet end, for instance by flushing with water as indicated at 24 and drying with air as indicated at 25.

Means for placing the resistance floor 2 under sub-pressure, pumps for recirculating liquid and various control equipment have not been illustrated in the very diagrammatic drawing of the apparatus according to the invention.

The method and the apparatus according to the invention will provide better results than the methods and devices presently used for continuously washing sulphate pulp. For a set capacity the apparatus according to the invention will have a substantially lower initial cost than previously known apparatus. It will also be cheaper in operation.

With a displacement rate of 5 cm/min (a relatively low displacement rate for sulphate pulp) and an effective filter surface of 60 $m^2$, 180 $m^3$ liquor per hour may be recovered, corresponding to approximately 20 ton wood-pulp per hour if the pulp has a concentration of 10%. This illustrates that the capacity necessary for practical use of the filter may readily be achieved. With a thickness of 30 cm of the pulp mat 14 and an effective filter length of about 10 m the screen 3 will have to be advanced at a rate of about 1.7 m/min, a very moderate rate which should not entail problems.

Whereas the average resistance through the pulp mat 14 at ordinary displacement rates may for instance lie in the order of 10–40 cm $H_2O$ (both lower and higher resistances may occur) a resistance floor 2 having a flow resistance of about 100–160 cm $H_2O$ at the same rate may easily be used, since the height of the displacement liquid 5 may for instance be about 100 cm and the under-pressure below the resistance floor 2 may for instance be of approximately the same order, i.e., corresponding to a water pressure of about 100 cm.

In the preceding description a short reference has been made to a controlled recirculation of displaced liquid, a control of the speed of the screen 3, that the resistance floor may have various designs and that the liquid-penetrable floor 15 may move together with the pulp 14 in order not to afford an excessive frictional resistance against the pulp. It will be understood that the apparatus which has been diagrammatically shown in the drawing may be further modified in a number of other ways and be provided with a number of further details. I.e., care should be taken that the pulp is fed to the inlet chest 12 in such a manner that a controlled formation of the pulp on the screen 3 is obtained and a varying hydrostatic pressure is avoided.

What I claim is:

1. A method for the continuous washing of liquid-containing pulp material with a displacement liquid, comprising traversing a filter along a predetermined path, supporting said filter throughout a substantial portion of said path upon a support floor, continuously depositing a mat of liquid-containing pulp material upon said filter for movement therewith, separately supplying displacement liquid to the upper surface of said mat of pulp material and maintaining a predetermined head of said displacement liquid thereon, said head of displacement liquid being sufficient to overcome the resistance to the flow of liquids through said mat offered by the average flow resistance of the mat and the additional resistance to flow offered by a resistance floor which includes at least one of said filter and support floor, whereby the liquids in said pulp material are continuously displaced by said displacement liquid, and recovering the displaced pulp liquids substantially undiluted by said displacement liquid.

2. A method according to claim 1, wherein said pulp material is fed to an inlet chamber positioned upstream of said filter and is accumulated therein to such level that the hydrostatic pressure at the level of the upper surface of said mat is substantially equal to the hydrostatic pressure of the displacement liquid at said surface of the mat.

3. A method according to claim 1, wherein said resistance floor is said support floor, said support floor being liquid-permeable, said displaced pulp liquids being urged through said resistance floor for recovery at a plurality of locations therealong, regulating the rate of advance of said filter to recover displaced pulp liquids from said locations at predetermined concentrations.

4. A method according to claim 3, wherein the liquids recovered from selected ones of said locations are recycled for use as displacement liquids.

5. A method according to claim 4, wherein said pulp material is fed to an inlet chamber positioned upstream of said filter and is accumulated therein to such level that the hydrostatic pressure at the level of the upper surface of said mat is substantially equal to the hydrostatic pressure of the displacement liquid at said surface of the mat.

6. A method according to claim 3, wherein said pulp material is fed to an inlet chamber positioned upstream of said filter and is accumulated therein to such level that the hydrostatic pressure at the level of the upper surface of said mat is substantially equal to the hydrostatic pressure of the displacement liquid at said surface of the mat.

7. A method according to claim 1, wherein said mat of liquid-containing pulp material is deposited upon a screen filter for movement thereupon.

8. A method according to claim 1, wherein said liquid-containing pulp material comprises sulphate pulp containing black liquor.

* * * * *